United States Patent [19]

Roznieckí

[11] Patent Number: 4,484,710

[45] Date of Patent: Nov. 27, 1984

[54] FIRE SUPPRESSANT NOZZLE

[75] Inventor: Edward J. Roznieckí, Macomb, Mich.

[73] Assignee: The United States of America as represented by the Secretary of the Army, Washington, D.C.

[21] Appl. No.: 474,398

[22] Filed: Mar. 11, 1983

[51] Int. Cl.[3] ..... B05B 1/28

[52] U.S. Cl. ..... 239/290; 239/DIG. 7; 239/428.5

[58] Field of Search ..... 239/428.5, 590.5, 599, 239/290, 291, DIG. 7, 590.3

[56] References Cited

U.S. PATENT DOCUMENTS 2,052,869 9/1936 Coanda .

2,780,496 2/1957 Asbeck ..... 239/290

2,989,249 6/1961 Richter ..... 239/590.3 X 3,735,778 5/1973 Garnier ..... 239/DIG. 7 X

*Primary Examiner*—John J. Love

*Assistant Examiner*—Daniel R. Edelbrock

*Attorney, Agent, or Firm*—Peter A. Taucher; John E. McRae; Robert P. Gibson

[57] ABSTRACT

A nozzle for discharging vaporizable liquid fire suppressant material toward a flame area to be suppressed. A nozzle includes internal mechanism for forcing an insulator shroud around the liquid fire suppressant while the suppressant is still within the nozzle. The shroud insulates the liquid material while the liquid stream is traveling toward the target flame, thereby preventing premature flashing or vaporization of the liquid. A particular aim of the invention is to increase the penetration distance, i.e., travel distance before the liquid is dissipated.

20 Claims, 13 Drawing Figures

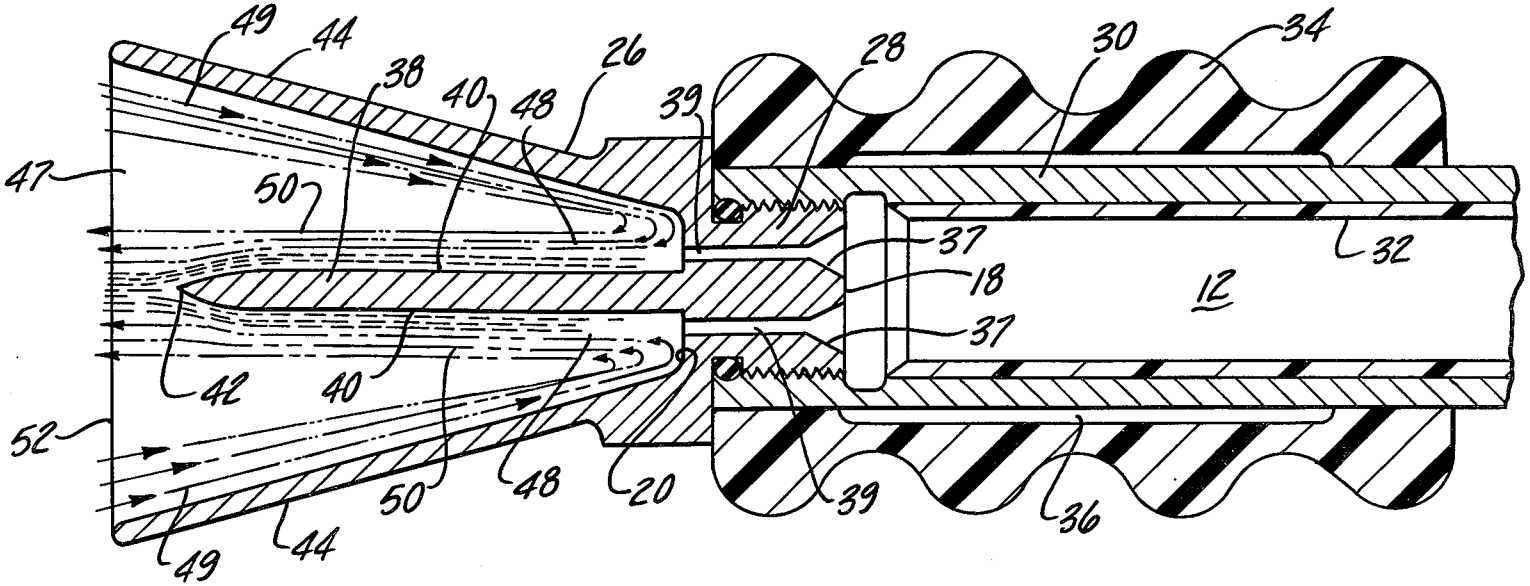
Fig-2
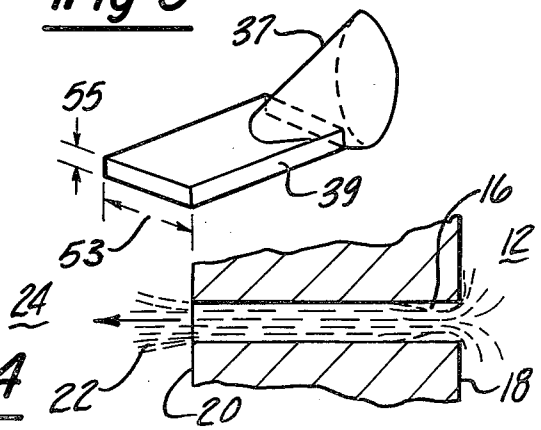
Fig-5
Fig-4
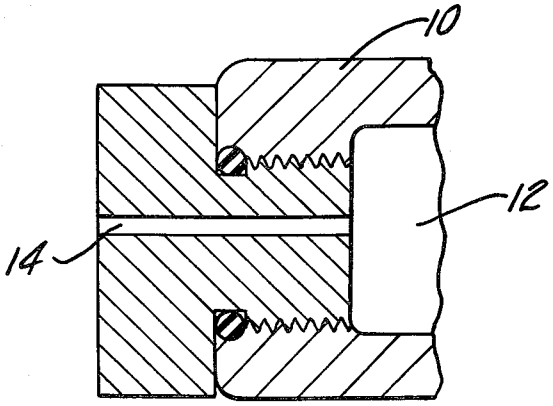
PRIOR ART
Fig-1
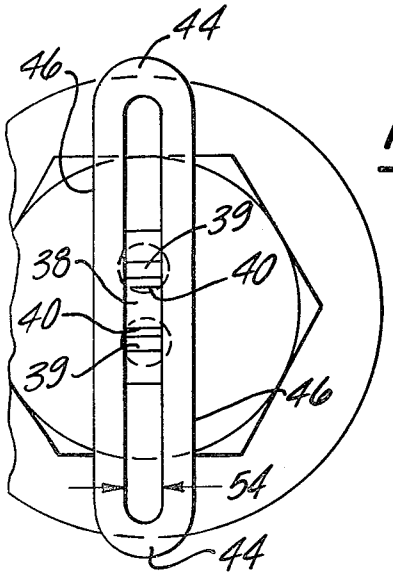
Fig-3

FIRE SUPPRESSANT NOZZLE

GOVERNMENT INTEREST

The invention described herein may be manufactured, used, and licensed by or for the Government for governmental purposes without payment to me of any royalty thereon.

BACKGROUND AND SUMMARY OF INVENTION

This invention relates to fire suppression mechanisms using vaporizable liquid fire suppressant, for example monobromotrifluoromethane, referenced in the literature as Halon 1301. This liquid material has very desirable fire-suppressant properties, e.g., low toxicity and physicochemical inhibition of the combustion reaction; or as a "chain breaking" agent, meaning that it acts to break the chain reaction of the combustion process. (National Fire Prevention Association, NFPA-12A National Standards Halon-1301 Fire Extinguishing Systems). However, the material has a relatively low boiling point of about minus 72° F., and a vapor pressure of about 215 p.s.i. at 70° F. These characteristics present the problem of excessive vaporization and flashing when the material is discharged as a thin jet stream from a nozzle toward the flame to be suppressed. As the thin liquid stream moves from the nozzle the stagnant ambient air tends to mix with the concentrated stream to diffuse or dissipate the stream. Additionally the mixed-in air heats the liquid stream to vaporize some of the suppressant liquid before it reaches the flame to be suppressed. Finally, the heat generated by the flame tends to further vaporize and dissipate the suppressant material before it can reach the flame zone. Intense heating of an air mass can create a strong thermal draft or wind, which can mechanically deflect the suppressant stream before it becomes effective on the flames. In some cases for example with portable extinguishers using Halon 1301, the liquid stream begins to dissipate at only about four feet from the nozzle. With other halogenated hydrocarbon fire suppressant material such as Halon 1211, the penetration range is somewhat greater, but at the expense of a more lethal toxicity factor. In any case, the penetration distance is somewhat affected by the intensity of heat generated by the flame; high temperatures outward from the flame area can vaporize or dissipate the suppressant before it is effective on the flame.

The principal object of the present invention is to increase the effective penetration range of a thin vaporizable liquid fire suppressant stream discharged from a nozzle. Preferred suppressant is monobromotrifluoromethane. The nozzle is constructed to form a coolant shroud (air or vaporizable liquid) around the fire suppressant jet stream. An important feature of the invention is that the coolant shroud is formed before the fire suppressant emerges from the nozzle; the nozzle includes an internal liquid-attachment wall structure that orients the liquid into a thin jet before the liquid reaches the nozzle exit opening. An internal free space exists within the nozzle for accommodating the shroud-forming material. Suppressant comes out of the nozzle at least partly surrounded by an insulating coolant shroud.

The coolant shroud travels with the jet stream for at least part of its travel to the fireball, thus shielding the jet stream from thermal contact with the stagnant ambient atmosphere. Thermal vaporization and flashing of the liquid in the jet stream is minimized, thereby enabling the jet to travel a relatively long distance before dissipating to a spent condition.

Hopefully the invention will make it possible for a human to operate a portable fire extinguisher while standing a relatively long distance from the flame; this is advantageous in that there is less likelihood that the intense heat will drive the human back from the flames to a point where he cannot deliver the suppressant to the most intense part of the flame where combustion inhibition is most necessary.

It is contemplated that the nozzle orifices will be relatively small to produce a relatively concentrated jet stream of liquid fire suppressant. Such a stream can be thermally shielded from the atmosphere by a sacrificial shroud, thereby enabling a high percentage of the suppressant liquid to impinge on and into the flame, rather than being spent before reaching the flame area. The desired concentrated stream can be aimed at the precise point where the flame is most intense.

THE DRAWINGS

FIG. 1 is a sectional view illustrating a generally conventional nozzle used for discharging vaporizable liquid fire suppressant toward a remote flame.

FIG. 2 is a longitudinal sectional view of a nozzle embodying my inventive concept.

FIG. 3 is a left end view of the FIG. 2 nozzle.

FIG. 4 is a sectional view through a conventional sharp-edged orifice to illustrate the flow pattern.

FIG. 5 is a perspective view of a liquid flow configuration obtained in the FIG. 2 nozzle.

Figure 7:
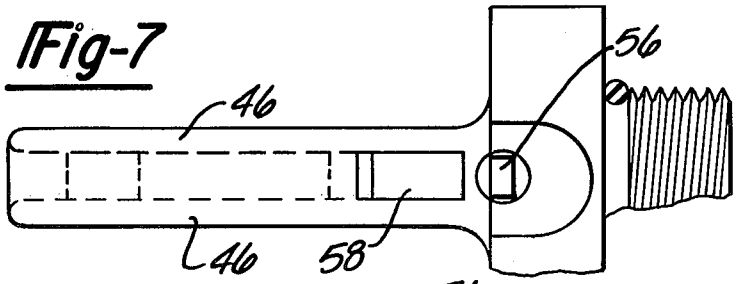
FIG. 7 is a top plan view of the FIG. 6 nozzle.

Referring in greater detail to FIG. 1, there is fragmentarily shown a conventional nozzle 10 for discharging vaporizable liquid fire suppressant from a nozzle chamber 12 leftwardly through a circular cross-section discharge orifice 14. One preferred usable fire suppressant material is liquid monobromotrifluoromethane pressurized with an inert gas to some suitable pressure, preferably at least 300 pounds per square inch, at 70° F. Nozzle 10 would in practice be associated with a non-illustrated thick-walled bottle containing the pressurized suppressant; the pressurizing agent is usually nitrogen introduced to the bottle after introduction of a predetermined quantity of liquid fire suppressant into the bottle. Nozzle 10 can be attached directly to the bottle; alternately the nozzle can be part of a tubular handle attached to a flexible hose or duct leading from the bottle. A manually-operable valve, not shown, is located on the bottle or nozzle to permit discharge of pressurized suppressant through nozzle orifice 14 toward the emergent fireball. The system is intended primarily to be a portable system operated by one man or woman to quickly suppress fires in a variety of different situations, e.g., in or around military vehicles in combat situations, electronic equipment rooms, kitchens, chemical installations, military depots, etc.

One problem with the FIG. 1 nozzle is the relatively short penetration distance of the liquid jet discharged from orifice 14. The short penetration distance is believed to be due at least partly to the fact that the pressurized liquid undergoes abrupt changes in direction and velocity as the liquid particles move from chamber 12 into orifice 14. While it is in chamber 12 the liquid is essentially motionless; it therefore has no significant movement direction. To proceed from chamber 12 into orifice 14 the liquid accelerates at a very high rate in different directions. As shown schematically in FIG. 4, the liquid particles converge toward the centerline of the orifice 14 passageway, thereby creating an annular low pressure zone 16 in the passageway near wall surface 18 of chamber 12. The liquid fire suppressant material is readily vaporized by the low pressure condition, such that bubbles are formed in the stream flowing leftwardly through the orifice 14 passageway. Such bubbles detract from the mass flow rate of suppressant, whereby the jet 22 issuing from exit face 20 of the orifice wall tends to be a liquid-vapor mixture rather than a concentrated liquid stream. Commonly there is some undesired divergence of the jet after it leaves orifice 14. These factors are believed to adversely affect the penetration distance of the jet, i.e., the distance the jet can travel before being dissipated.

Penetration distance of liquid jet 22 is also believed to be adversely affected by interactions between the jet boundary surface and the relatively stagnant atmosphere 24 surrounding the free jet. The ambient atmosphere exerts a heating effect on the jet, tending to cause some or all of the jet liquid to flash into the vapor state. Interaction of the ambient atmosphere with the liquid jet boundary layer may also generate mechanical turbulence and localized low pressure conditions, leading to further undesired flashing of the jet liquid before the jet reaches the target fireball.

The present invention, as exemplified in FIGS. 2, 3 and 5, proposes improvements in the nozzle orifice structure, and additions to the nozzle structure for protecting the liquid jet from adverse heating effects after it exits from the nozzle orifice. FIG. 2 fragmentarily shows a fire suppressant system that includes a nozzle 26, having an orifice wall 28 that is screwed into a tubular member 30. The right end of member 30, not shown, may be connected to a thick-walled bottle containing pressurized vaporizable liquid fire-suppressant material, such as monobromotrifluoromethane (Halon 1301). Alternately, member 30 can transition into a flexible hose that connects to the bottle. Tubular member 30 can be provided with a liner 32 formed of plastic or other material having a relatively low coefficient of heat transfer. An annular tubular handle 34, of rubber or plastic, is slipped over member 30. Preferably, an annular space 36 is provided at the handle-member 30 interface to further minimize heat transfer between the human operator's hand and the relatively cold liquid in the defined chamber 12. Liquid flows in a right-to-left direction. When nozzle 26 is secured to member 30 orifice wall 28 forms a pressure-containment end wall for chamber 12.

A feature of my invention, as shown in FIG. 2, is the structure of orifice wall 28. Two similar orifices are formed through the wall from inlet face 18 to exit face 20. Each orifice comprises a frusto-conical recess 37 in face 18, and a slot-like passage 39 leading from recess 37 to exit face 20. Recess 37 is tapered or convergent in the direction of flow, whereby the liquid undergoes a relatively gradual change in velocity and direction as the liquid particles proceed from chamber 12 into passage 39. FIG. 5 is a perspective view of the passageway formed by recess 37 and slot 39 (i.e., devoid of the structure used to form the flow space). Frusto-conical recess 37 advantageously uses a large percentage of the face 18 area, and provides a relatively smooth flow transition to slot 39, thereby greatly minimizing the possibility for bubble formation depicted at 16 in FIG. 4.

Nozzle 26 includes a central elongated wall structure 38 extending from a point on orifice wall 20 midway between the two slot-like orifices 39. Structure 38 defines two parallel flat elongated surfaces 40 extending in the direction of liquid flow to function as liquid-attachment surfaces for liquids discharged from the associated flow orifices 39. Each attachment surface 40 begins at a point near one edge of the associated slot 39 so that liquid discharged from the slot quickly attaches to the wall 40 surface due to the Coanda effect, described for example in U.S. Pat. No. 2,052,869 issued Sept. 1, 1936. The downstream end of central wall 38 is configured as a spade-like convergent tip 42, whereby the liquid streams flowing along surfaces 40 are caused to merge into a single stream as they leave the tip edge.

Nozzle 26 further includes a shroud structure defined by two divergent walls 44,44 and interconnecting flat parallel walls 46,46. The juncture between each divergent wall 44 and the orifice wall 28 is relatively remote from the associated orifice 39; i.e., each orifice is closer to the associated attachment surface 40 than to the inner surface of shroud wall 44. Therefore the liquid coming out of each orifice 39 will attach to a surface 40 rather than to shroud wall 44. Walls 44 diverge from one another in the downstream direction to form a relatively wide mouth 47. Liquid flow along surface 40 creates low pressure conditions in zones 48 at the flowing liquid boundary layers. Atmospheric air is drawn into mouth 47 toward each zone 48, as denoted by flow lines 49. The air in each zone 48 is drawn onto the liquid boundary layer for movement with the liquid, as denoted by arrows 50.

Tip 42 on wall structure 38 is located within the shroud, such that when the single liquid stream emerges from the shroud it has an insulating air film on its major surfaces. It is desired that the insulating air film or shroud be formed on the liquid boundary surface while the liquid is still attached to the attachment surface 40. At that time the liquid is in a relatively dense compact condition; attachment surface 40 prevents the liquid jet from exhibiting the divergence depicted in the FIG. 4 conventional arrangement. When the relatively compact liquid jet leaves the nozzle discharge plane 52 it already has a surrounding insulator film (air) thereon. The surrounding insulator film at least partially isolates the flowing liquid from the ambient atmosphere, thereby minimizing undesired heating of the liquid and/or mechanical turbulence along the liquid boundary layer.

As best shown in diagrammatic FIG. 5, each liquid orifice 39 has a rectangular slot-like cross section wherein the major dimension 53 is three or four times the minor dimension 55. The spacing between shroud walls 46 (FIG. 3) is preferably the same as the major cross-sectional dimension of each orifice 39 to minimize lateral divergence of the liquid stream as it leaves orifice 39.

A principal feature of interest in connection with the FIG. 2 nozzle construction is the configuration of each discharge orifice whereby a convergent passage 37 provides a gradual transition to the slot-like passage 39; the emergent stream is a compact thin jet largely devoid of the bubble condition depicted in FIG. 4. Another feature of interest is the liquid attachment surface 40 located within a shroud structure, whereby an insulator film of air is assimilated onto the liquid jet while it is in a relatively compact condition, i.e., before it has had an opportunity to diffuse or dissipate. It is believed that these cooperating features will improve the effective penetration of the liquid jet, and thus improve the effectiveness of the fire suppressant nozzle system.

FIGS. 6 through 13 show nozzle components adapted to be screwed into handle constructions similar to the handle structure shown in FIG. 2. In each case the nozzle component includes an orifice wall adapted to function as a liquid pressure-containment end wall for a chamber corresponding to the defined chamber 12 in FIG. 2. To simplify the drawings the handle-chamber structure of FIG. 2 is omitted from FIGS. 6 through 13.

Figure 6:
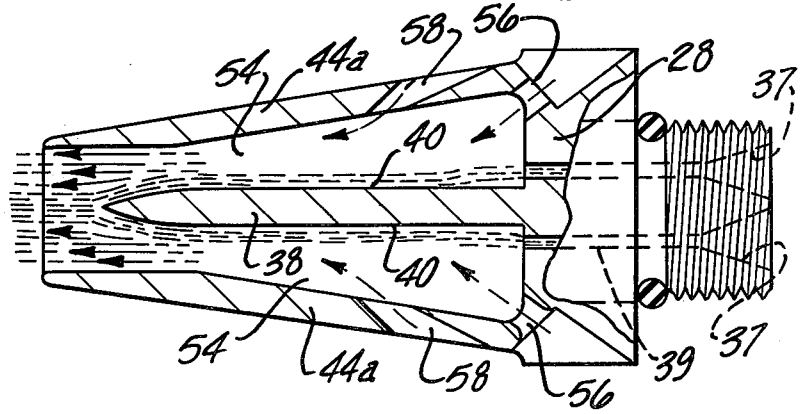
FIG. 6 is a sectional view similar to FIG. 2, but illustrating a second embodiment of the invention.

FIGS. 6 and 7 show a nozzle structure that is generally similar to the FIG. 2 construction except for the nature of the shroud. In this case the shroud walls 44*a* are generally convergent in the downstream direction, rather than divergent. Insulating air is admitted into each shroud space 54 through air entrance openings 56 near the junctures between walls 44*a* and orifice wall 28. Additional air may be admitted to shroud space 54 through downstream openings 58. Openings 56 and 58 are sufficiently sized to preclude vacuum conditions within shroud space 54. Air flow is induced through openings 56 and 58 onto the boundary surfaces of the liquids flowing along attachment surfaces 40. Operating of the FIG. 6 structure is similar to that of the FIG. 2 structure.

Figure 8:
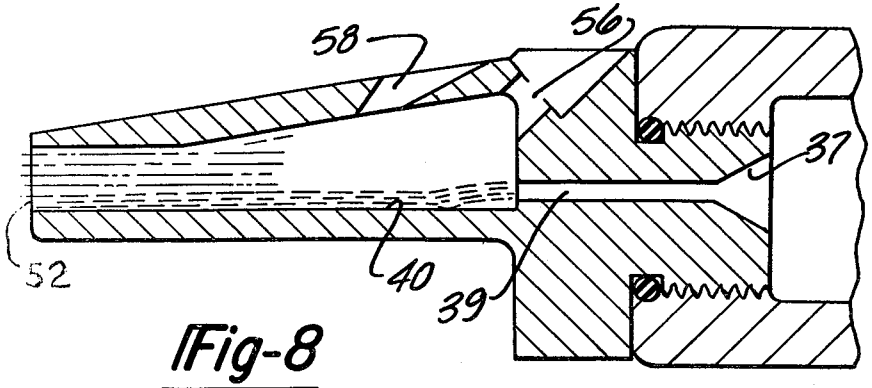
FIG. 8 is a sectional view similar to FIG. 6, but showing a structural variation using only one internal liquid-attachment surface, as opposed to the two attachment surfaces shown in FIG. 6.

FIG. 8 is essentially similar to FIG. 6 except that the FIG. 8 structure includes only one liquid orifice and one liquid attachment surface. The liquid emerging from the shroud discharge plane 52 is only partially surrounded by an insulator film.

Figure 9:
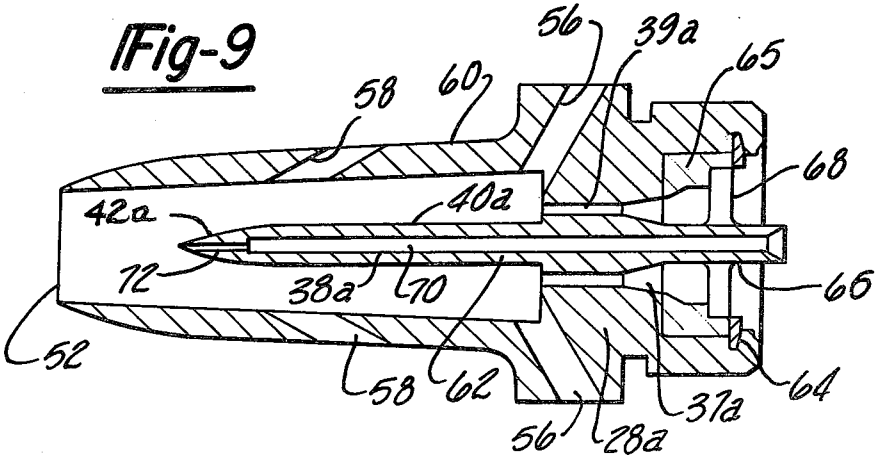
FIG. 9 is a view similar to FIG. 6, but illustrating a modification wherein the liquid-attachment surface is circular, rather than being flat as in FIG. 6.
Figure 10:
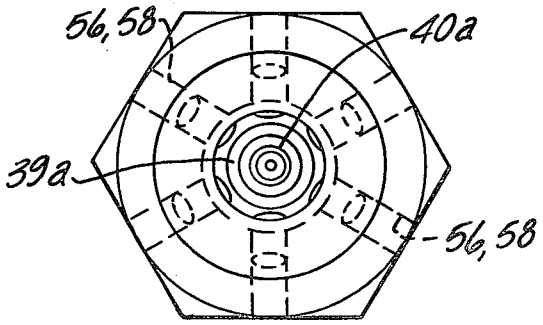
FIG. 10 is a left end view of the FIG. 9 nozzle.

FIGS. 9 and 10 illustrate a form of the invention wherein the liquid orifice mechanism is an annulus, and the liquid attachment surface is cylindrical (rather than being flat). The nozzle includes a major housing member 60 having an insert 62 mounted therein by means of a snapring 64. Insert 62 includes an outer cylindrical section 65 joined to an inner tubular section 66 by one or more integral struts 68. Members 60 and 62 cooperatively form an annular convergent orifice passageway 37*a* and annular cylindrical orifice passageway 39*a*. The liquid issues from passageway 39*a* as a relatively thin annular jet.

The liquid attachment surface is a cylindrical surface 40*a* formed by a tubular wall structure 38*a* that projects in a downstream direction from the nozzle orifice wall 28*a*. Liquid flows along annular attachment surface 40*a* to a convergent tip 42*a* where the liquid components merge into a solid circular cross-section jet. Air entrance openings 56 and 58 in housing 60 permit ambient air to be drawn onto the liquid surface while the liquid is still attached to tubular structure 38*a*. To maintain the liquid as cool as possible, for as long as possible, the tubular structure 38*a* may have a central coolant passage 70 therein communicating with the pressurized liquid in chamber 12 (not shown in FIG. 9). A small orifice 72 in tip 42*a* enables the internal coolant to exhaust into the main liquid jet without significant effect on the jet character. Passage 70 is intended to be a means for cooling attachment surface 40*a* and the liquid attached thereto, thereby minimizing any tendency toward premature vaporization of the liquid while it is flowing along surface 40*a* or after it has left the shroud. It is desirable to have the liquid as cold as possible when it leaves the shroud discharge plane 52, to minimize vaporization possibility before the target flame area is reached.

Figure 11:
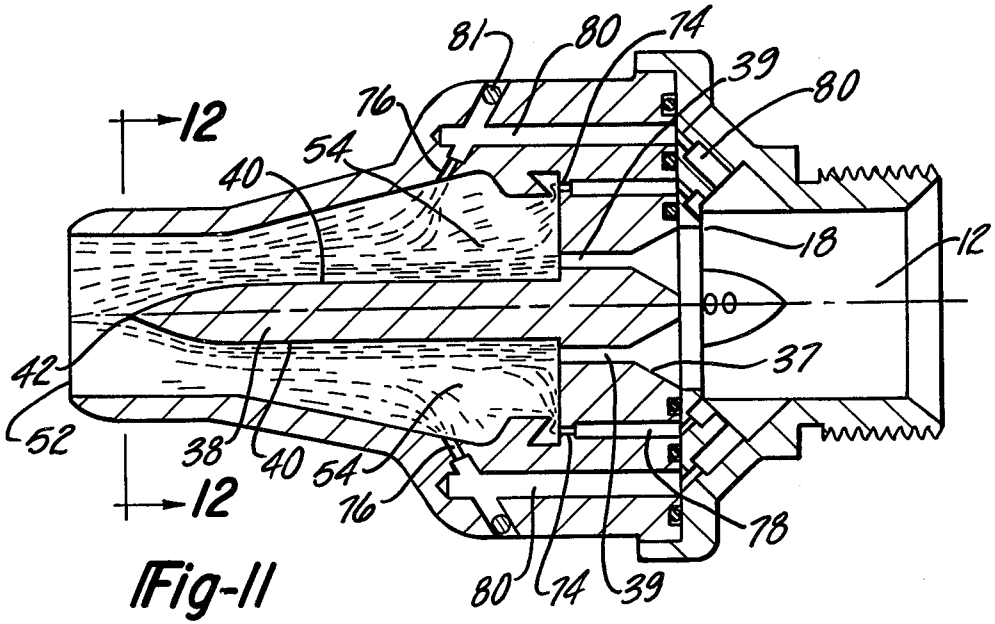
FIG. 11 is a longitudinal sectional view taken through a nozzle adapted to form a coolant shroud from vaporizable liquid taken from the main liquid supply.
Figure 13:
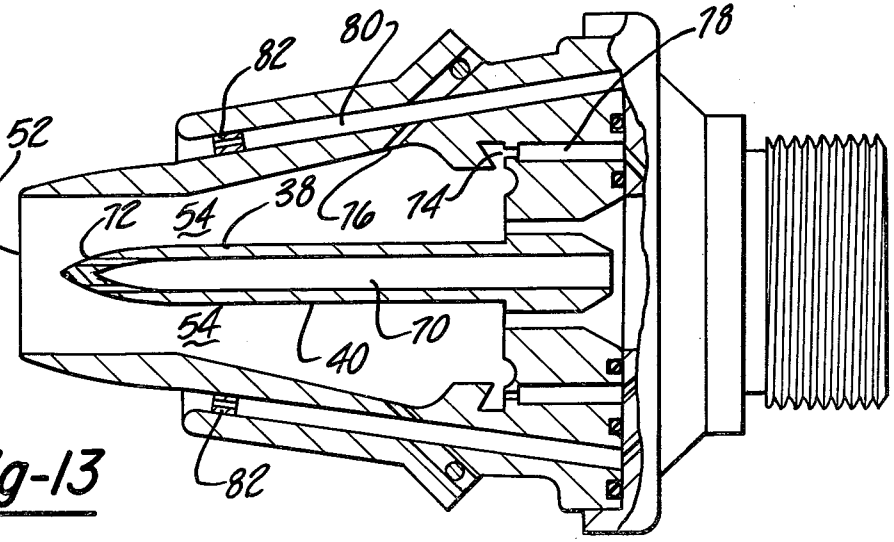
FIG. 13 is a sectional view illustrating a variant of the nozzle shown in FIG. 11.
Figure 12:
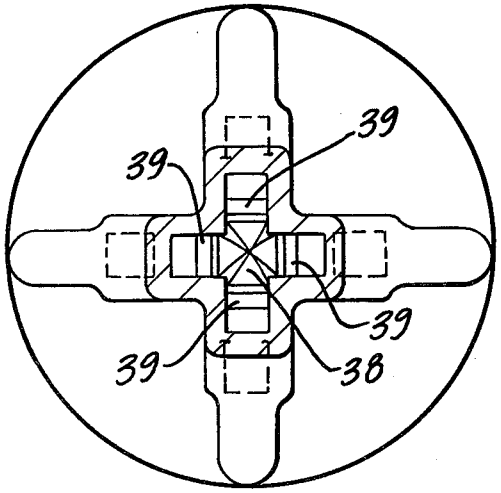
FIG. 12 is a sectional view taken on line 12—12 in FIG. 11.

FIGS. 11 and 12 show an embodiment of the invention wherein the shrouding film around the liquid stream is formed by a vaporized liquid having liquid-coolant properties. The fluid shroud thus acts as both an insulator against the ambient atmosphere and as a cooling mechanism for the main liquid jet. The main component liquid streams are discharged from four slot-like orifices 39 onto four flat attachment surfaces 40 on the central wall structure 38. Each primary orifice 39 has associated therewith two secondary orifices 74 and 76. Each orifice 74 is connected to a passageway 78 that extends through the orifice wall structure into communication with chamber 12. Each orifice 76 is connected to a passageway 80 that also communicates with chamber 12; a plug 81 is disposed in one of the drilled holes defining each passageway 80. Each of the secondary orifices 74 and 76 has a relatively small flow area, whereby the chamber 12 liquid experiences an appreciable pressure drop as it flows through the orifice. Because of its reduced pressure condition the fluid material is in a vapor state when it reaches shroud space 54. The vapor is assimilated onto the primary liquid flowing along the associated attachment surface 40. The process is similar to the flow-inducer action taking place in connection with the air-type shroud systems of FIGS. 2 through 10. FIGS. 11 through 13 feature vapor shroud systems having insulating and cooling properties. FIGS. 2 through 10 feature air type shroud systems having insulating properties, without significant cooling action.

FIG. 13 shows a variant of the FIG. 11 construction wherein the central wall structure 38 is internally cooled via a passage system 70, 72 similar to that used in the FIG. 9 invention embodiment. FIG. 13 also shows auxiliary orifices 82 for discharging secondary stream of vapor along the outer surfaces of the nozzle wall. The discharged vapor cools the nozzle wall, and may also add to the thickness of the vaporous shroud formed in spaces 54. The various secondary orifices 74, 76 and 82 act as fixed expansion valves enabling the refrigerant (bromotrifluoromethane) to cool the nozzle wall surfaces and the interior spaces within the nozzle. The liquid passing across the nozzle discharge plane 52 is thus in a relatively cool condition.

In each of the described embodiments it is desirable that the nozzle walls be formed of a material having a relatively low coefficient of heat transfer and low specific heat. Otherwise the nozzle walls may contribute heat energy to the liquid while it is flowing along the attachment surfaces, thus contributing to premature vaporization of the liquid. The problem is of particular concern at initial opening of the nozzle when the nozzle walls are at room temperature; the heating effect of the relatively warm walls should be kept to a minimum. To minimize undesired heating the nozzle walls are preferably formed of plastic or other high thermal resistance material. Selected interior surfaces of the nozzle in direct contact with the liquid may advantageously have a film of thermally-conductive material thereon, e.g. by nickel plating. The liquid attachment surfaces on wall structure 38 (or 38*a*) are the surfaces that would most benefit by having thermally-conductive films thereon. The cold surface on the metallic film reflects cold back into the liquid and also acts as a physical barrier between the turbulent liquid and base material (plastic). Liquid turbulent-scrubbing effects are not experienced by the plastic surface; therefore high coefficients of heat transfer associated with such scrubbing are not present.

I wish it to be understood that I do not desire to be limited to the exact details of construction shown and described for obvious modifications will occur to a person skilled in the art.

I claim:

1. A nozzle for discharging vaporizable liquid fire suppressant onto a fireball located a substantial distance from the nozzle; said nozzle comprising liquid chamber means adapted to receive liquid suppressant from a pressurized liquid source, said chamber means including a pressure-containment wall having a primary orifice therethrough for discharging a concentrated liquid suppressant stream, a liquid-attachment wall extending from the pressure-containment wall in the downstream direction, said liquid-attachment wall defining a liquid attachment surface that begins at a point near an edge of the orifice exit opening, a shroud wall extending from the pressure-containment wall in spaced relation to the liquid attachment surface, said liquid-attachment surface being closer to the orifice than the shroud wall so that the liquid stream attaches to the liquid-attachment surface rather than the shroud wall, and means for admitting an insulating fluid to the space between the shroud wall and the liquid stream prior to the time that the liquid stream leaves the liquid-attachment surface, whereby the leaving liquid stream is at least partially surrounded by an insulating fluid entrained onto the liquid stream.

2. The nozzle of claim 1: said admitting means comprising an air entrance opening in the shroud wall near the juncture between the shroud wall and the pressure-containment wall.

3. The nozzle of claim 2 the admitting means comprising a second air entrance opening in the shroud wall downstream from the first-mentioned air opening; the air entrance openings being sufficiently sized to preclude vacuum conditions within the space between the liquid-attachment wall and shroud wall.

4. The nozzle of claim 1: the internal surface of said shroud wall having a significant divergence away from the liquid-attachment surface as the shroud wall proceeds in a downstream direction from the pressure-containment wall, the downstream ends of the liquid-attachment wall and shroud wall forming a relatively wide mouth (47) sufficiently sized to accommodate incoming air near the shroud wall and outgoing liquid fire suppressant at the attachment wall; the defined mouth constituting the aforementioned means for admitting an insulating fluid to the space between the shroud wall and the liquid stream.

5. The nozzle of claim 1: the admitting means comprising a secondary orifice in one of said pressure-containment wall and shroud wall, and passage means extending from the aforementioned liquid chamber means to the secondary orifice, whereby pressurized suppressant is ejected through the secondary orifice into the zone adjacent the liquid stream flowing along the attachment surface.

6. The nozzle of claim 5: said secondary orifice having a flow area significantly less than that of the primary orifice.

7. The nozzle of claim 1: said primary orifice having a rectangular slot-like cross-section whose major dimension is at least three times its minor dimension.

8. The nozzle of claim 7 wherein said liquid attachment surface is flat, the flat attachment surface being parallel to the major surfaces of the slot-like orifice, whereby a major boundary layer of the liquid stream discharged from the orifice occupies a plane parallel to the attachment surface.

9. The nozzle of claim 8 wherein the upstream face of the pressure-containment wall has a tapered recess therein communicating with the slot-like orifice, said recess being convergent in the direction of flow so that liquid suppressant undergoes a relatively gradual change in velocity and direction as it proceeds from the chamber means into the slot-like orifice.

10. The nozzle of claim 1: said pressure-containment wall having two duplicative primary orifices therethrough, said liquid-attachment wall extending from a point on the pressure-containment wall midway between the two primary orifices, said liquid-attachment wall defining an attachment surface for each of two liquid suppressant streams issuing from the primary orifices.

11. The nozzle of claim 10: each primary orifice having a rectangular slot-like cross-section whose major dimension is at least three times its minor dimension, each liquid attachment surface being flat and parallel to a major flat surface of the associated primary orifice, whereby a major boundary layer of each liquid stream moves parallel to the adjacent attachment surface after the respective stream exits from the orifice.

12. The nozzle of claim 11: the downstream end areas of the liquid attachment surfaces being gradually convergent to form a V-shaped tip enabling the attached liquid streams to merge into a single stream.

13. The nozzle of claim 1: said pressure-containment wall and liquid-attachment wall being formed of a high thermal resistance material.

14. The nozzle of claim 10: said pressure-containment wall and liquid-attachment wall having a film of thermally-conductive material thereon.

15. The nozzle of claim 1: said liquid-attachment wall having at least one passage therein communicating with the liquid chamber means for cooling the wall, thereby minimizing the tendency of the primary liquid stream to absorb heat from the attachment wall.

16. The nozzle of claim 15: said liquid-attachment wall having a port near its downstream end for exhausting fluid from the internal passage into the primary liquid stream.

17. The nozzle of claim 1 wherein the primary orifice is annular, and the liquid attachment wall is cylindrical; said attachment wall and annular orifice being concentric.

18. A nozzle for discharging vaporizable liquid fire suppressant onto a fireball located a substantial distance from the nozzle; said nozzle comprising a first tubular member adapted to receive liquid suppressant from a pressurized liquid source, and a second member having a threaded end wall screwable into the tubular member, said end wall having a primary orifice extending therethrough for discharging a primary suppressant stream out of the tubular member toward the remote fireball; said second member including two generally parallel side walls extending from the end wall in the direction of the fluid flow, a liquid-attachment wall interconnecting said side walls, and a shroud wall interconnecting said side walls in spaced relation to the liquid-attachment wall, said liquid-attachment wall extending from the aforementioned end wall at a point near one edge of the primary orifice so that the liquid stream attaches to the liquid-attachment wall rather than the shroud wall; and means for admitting coolant to the space between the shroud wall and the liquid stream on the attachment wall.

19. The nozzle of claim 18: said liquid-attachment wall and primary orifice having flat internal surfaces parallel to, but offset from, one another whereby the primary stream passes across a low pressure attachment zone at the point where the attachment wall joins the end wall.

20. The nozzle of claim 18 wherein said shroud wall is convergent toward the liquid attachment wall measured in a downstream direction.

* * * * *

UNITED STATES PATENT AND TRADEMARK OFFICE

CERTIFICATE OF CORRECTION

PATENT NO. : 4,484,710

DATED : November 27, 1984

INVENTOR(S) : Edward J. Rozniecki

It is certified that error appears in the above-identified patent and that said Letters Patent is hereby corrected as shown below:

On the title page, delete "(73) Assignee: The United States of America as represented by the Secretary of the Army, Washington, D.C.".

Signed and Sealed this

Nineteenth Day of January, 1988

*Attest:*

*Attesting Officer*

DONALD J. QUIGG

*Commissioner of Patents and Trademarks*